US008608366B2

(12) United States Patent
Wang

(10) Patent No.: US 8,608,366 B2
(45) Date of Patent: Dec. 17, 2013

(54) SCREW-SHAPED LED

(76) Inventor: Yi Wang, Guangdong (CN)

( * ) Notice: Subject to any disclaimer, the term of this patent is extended or adjusted under 35 U.S.C. 154(b) by 236 days.

(21) Appl. No.: 13/255,103

(22) PCT Filed: Mar. 9, 2009

(86) PCT No.: PCT/CN2009/070689

§ 371 (c)(1),
(2), (4) Date: Sep. 6, 2011

(87) PCT Pub. No.: WO2010/102438

PCT Pub. Date: Sep. 16, 2010

(65) Prior Publication Data

US 2012/0002426 A1 Jan. 5, 2012

(51) Int. Cl.
*F21V 21/08* (2006.01)

(52) U.S. Cl.
USPC ..... 362/650; 362/649; 362/800

(58) Field of Classification Search
USPC ..... 362/249.02, 311.02, 800, 649, 650, 651
See application file for complete search history.

(56) References Cited

U.S. PATENT DOCUMENTS

| | | | | |
|---|---|---|---|---|
| 2009/0237940 | A1* | 9/2009 | Wu et al. | 362/280 |
| 2010/0141144 | A1* | 6/2010 | Hofmann et al. | 315/32 |
| 2010/0177515 | A1* | 7/2010 | Shoushtari | 362/249.02 |
| 2011/0182074 | A1* | 7/2011 | Hemerle | 362/294 |
| 2011/0266938 | A1* | 11/2011 | Juang et al. | 313/46 |

* cited by examiner

*Primary Examiner* — Laura Tso
(74) *Attorney, Agent, or Firm* — George G. Wang; Bei & Ocean

(57) ABSTRACT

A screw-shaped LED including a high power LED, a metal circuit board, power supply cords, and a screw-shaped housing. The high power LED and the metal circuit board are both mounted inside the screw-shaped housing. Within the housing, the high power LED is fixed on and electrically connected with the metal circuit board. The power supply cords are electrically connected with the metal circuit board and pass through the screw-shaped housing.

11 Claims, 12 Drawing Sheets

SCREW-SHAPED LED

FIELD OF THE INVENTION

The present invention relates to an LED, in particularly, relates to a high power screw-shaped LED.

BACKGROUND OF THE INVENTION

LED is the abbreviation of Light Emitting Diode, which is a type of solid semiconductor that may transform electricity directly into light. Although it is comparatively more expensive than conventional lighting instrument, it is believed that it will eventually replace the conventional lighting instrument due to its advantage of using low voltage power source, lower power consumption, better adaptability, higher stability, faster response, more environment friendly, and capable of multi-color lighting. Presently, high power LEDs, with a power rating of 1W, 3W, 5W or more, share one thing in common: they must first be secured onto a metal circuit board, such as a aluminum substrate, which is then bonded to a heat sinking housing in order to dissipate the heat generated during operation of the LED, thereby ensuring sufficiently long service life of the high power LED. Therefore, it imposes stringent requirements to the structure of the heat sinking housing, requiring very expensive mold. Once the mold is set, the shape cannot be changed, which is not very conducive to designing a number of lamps in a series.

At present, energy crisis urges many countries to focus on energy saving. Conventional incandescent bulbs and tungsten bulbs are lower in the manufacturing cost, but they are poorer in other respects, such as, lighting efficiency (thermal effect resulting ineffective consumption of electricity), energy consumption, service life span, and maintenance efforts, which will eventually making the incandescent and tungsten bulbs obsolete. Thus, the lighting instrument designed for such bulbs will be useless, resulting in a huge waste. In view of this, there is a need for a type of LED products which has good compatibility to and can be used with the existing lighting instrument designed for incandescent bulbs and tungsten bulbs.

SUMMARY OF THE INVENTION

The object of present invention is to provide a screw-shaped LED which has an advantage in heat dissipation, adaptability, freedom in combinatorial uses, and comparability to a conventional lamp.

The object is achieved by the following technical solutions, which comprises a high power LED, a metal circuit board, a power cord and a screw-shaped housing, wherein the high power LED and the metal circuit board are disposed inside the screw-shaped housing. The high power LED is secured on and connected to the metal circuit board, and the power cord is electrically connected with the metal circuit board and extends out of the screw-shaped housing.

The heat generated during operation of the LED according to present invention may dissipate outwards through the screw-shaped metal housing. The design of a screw shape not only increases the heat sinking area, but also facilitates mounting. On the mounting panel where the LED is to be mounted, a mounting hole is drilled and threaded in accordance with the specification of the screw-shaped housing, with the thread of the mounting hole matching with the thread of the screw-shaped housing. Then the screw-shaped LED is screwed directly into the mounting hole. Alternatively, the mounting hole is drilled on a panel without any thread. Then the screw-shaped LED is inserted into this mounting hole and is compressed against the panel by means of the fittings provided, thereby accomplishing the mounting of the screw-shaped LED.

As one embodiment of present invention, the screw-shaped housing has a sleeve structure with outer thread, wherein the screw-shaped housing has inside an inner cavity with one end being closed and the other end open, and the high power LED and the metal circuit board are both disposed inside the inner cavity of the screw-shaped housing. The sleeve structure of the housing facilitates manufacture and processing. Naturally, other structures with outer thread may also be adopted according to actual requirements.

As a further embodiment of the present invention, it comprises an additional thermal conductor, which is disposed inside the screw-shaped housing and connected with an inner wall of the screw-shaped housing and with the metal circuit board. With the thermal conductor, the heat generated during operation of the high power LED may be transferred to the screw-shaped housing hence dissipated outward.

The thermal conductor may take a form of sheet shaped thermal conducting structure, which is disposed between the metal circuit board and the bottom of the screw-shaped housing, and closely contacts the two respectively, by means of which the heat generated during operation of the high power LED is transferred to the screw-shaped housing to dissipate.

The thermal conductor may also take a form of block shaped thermal conducting structure (e.g. the injection molding type), provided that it surrounds the metal circuit board and leaves a space corresponding to the high power LED.

Typically, the thermal conductor may select the soft silica gel materials with good thermal conductivity, while other materials with good thermal conductivity may be used as well.

As a further embodiment of present invention, it comprises a converging lens, which is disposed at the open end of the inner cavity of the screw-shaped housing, with its position adapted to the high power LED. The converging lens may converge the light emitted from the high power LED.

The above screw-shaped LED is applicable to a mounting panel having a structure with certain thickness. During the process of mounting, a thread hole matching the screw-shaped housing is drilled in the panel, which the LED together with the screw-shaped housing is screwed into, achieving the mounting and positioning of the screw-shaped LED.

As further development of present invention, it comprises a positioning mechanism for mounting, which is threadly connected with the screw-shaped housing, and comprises a cover lid and a fixing ring, both having respective inner walls with threads matching the screw-shaped housing.

The above screw-shaped LED with the positioning mechanism for mounting is suitable for a thin sheet structure as the mounting panel, and is secured on the panel by means of the cover lid and the fixing ring.

The screw design of the screw-shaped LED according to the present invention may greatly increase the heat sinking area compared with that in prior art, by means of which the LED overcomes the heat sinking difficulty on its own, without needing additional effort on solving the heat sinking issue of the lamps or the housing of the lamps. Further, the LED according to the present invention is easy to use, and a number of them may be combined freely in any appropriate way, which leaves many options to the users. The LED according to present invention provides good compatibility with current lamps, which is realized just by removing the existing cover lid, replacing it with a matching panel on which one or more screw-shaped LED are mounted, and then electrically connecting it. With present invention, it is possible to retrofit a wide variety of conventional lamps such as, for example, street lamps, tunnel lamps, outer wall lamps and the like, resulting in energy saving and environment friendliness.

BRIEF DESCRIPTION OF THE DRAWINGS

A further detail description of present invention is given in conjunction with the accompany drawings and the specific embodiments of present invention, wherein.

DETAILED DESCRIPTION OF PARTICULAR EMBODIMENTS OF THE INVENTION

Embodiment I

Figure 1:
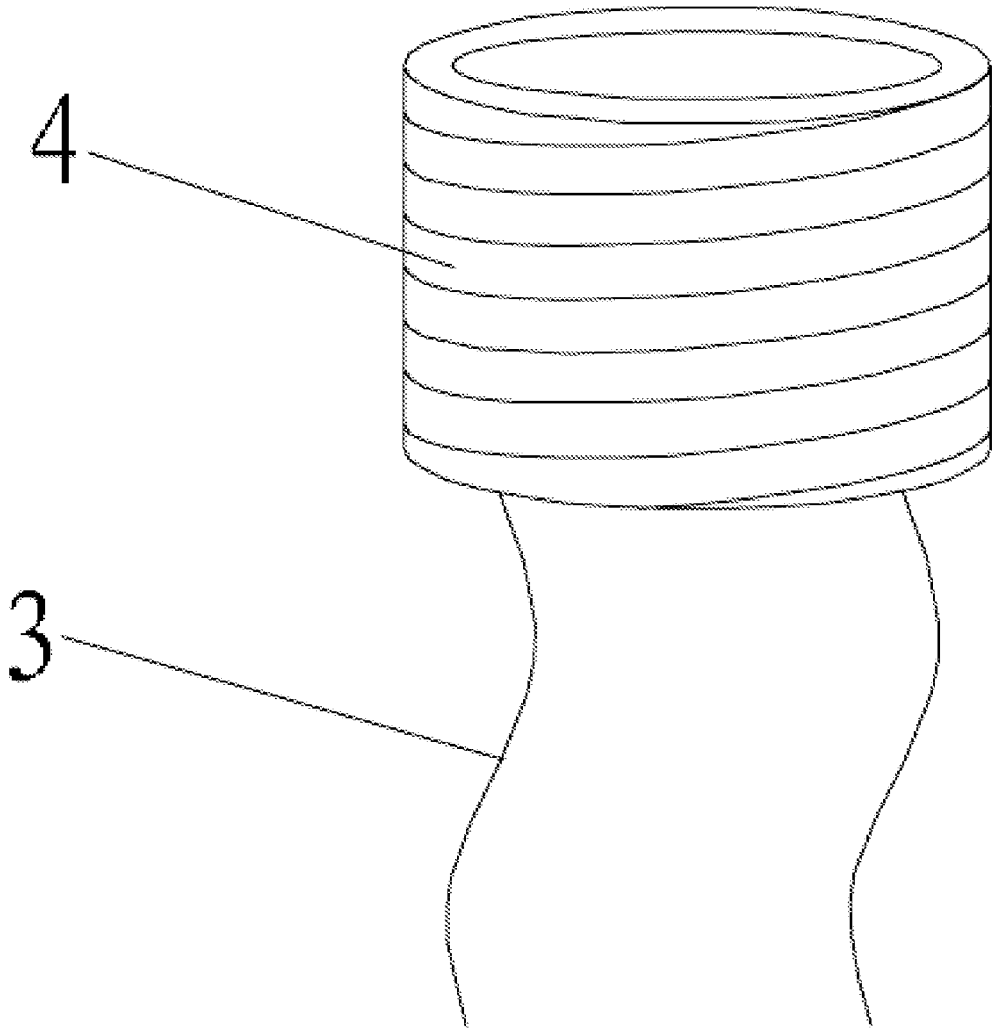
FIG. 1 depicts a schematic diagram of the overall structure of the first embodiment of the screw-shaped LED according to present invention.
Figure 2:
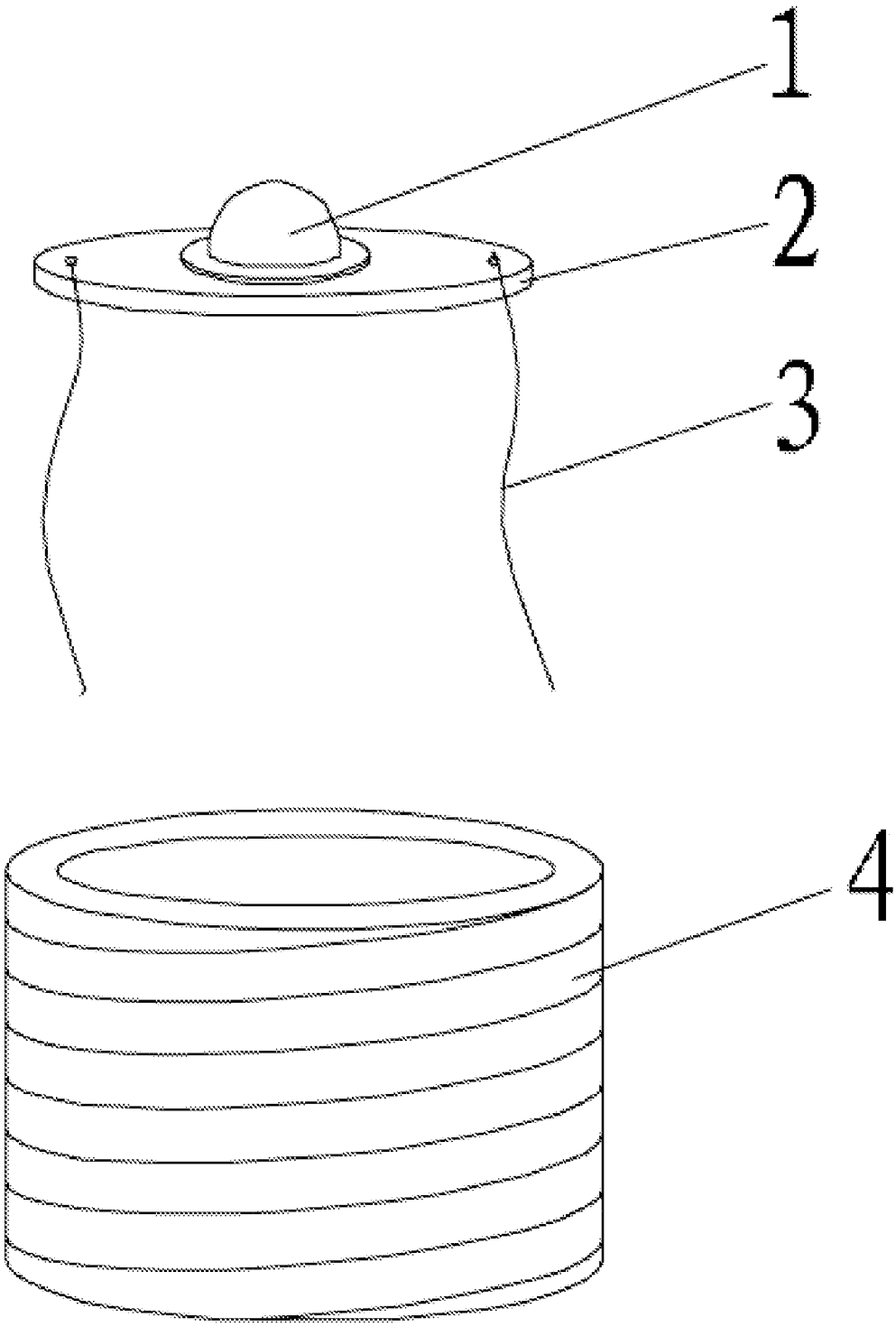
FIG. 2 depicts an exploded schematic diagram of the first embodiment of the screw-shaped LED according to present invention.

As shown in FIG. 1 and FIG. 2, a screw-shaped LED comprises a high power LED 1, a metal circuit board 2, a power cord 3 and a screw-shaped housing 4, wherein the screw-shaped housing 4 has a sleeve structure with an outer thread, and the screw-shaped housing 4 has inside an inner cavity with one end being closed and the other end open. The high power LED 1 and the metal circuit board 2 both are disposed inside the inner cavity in the screw-shaped housing 4, wherein the high power LED 1 and the power cord 3 are both soldered on the metal circuit board 2 and electrically connected thereto. The power cord 3 extends out of the screw-shaped housing 4.

The heat generated during operation of the screw-shaped LED is dissipated out directly though the screw-shaped housing 4 made of metal, which greatly increases the heat sinking area, by means of which the screw-shaped LED eliminates the heat sinking difficulties on its own. Thus, it is not necessary to invest effort on effecting the heat dissipation for the lamp bulb or lamp housing. At the same time, the screw-shaped housing 4 is easy for mounting and fixing.

In addition, the screw-shaped housing 4 of the present embodiment may take other properly shaped structure with an outer thread.

Embodiment II

Figure 3:
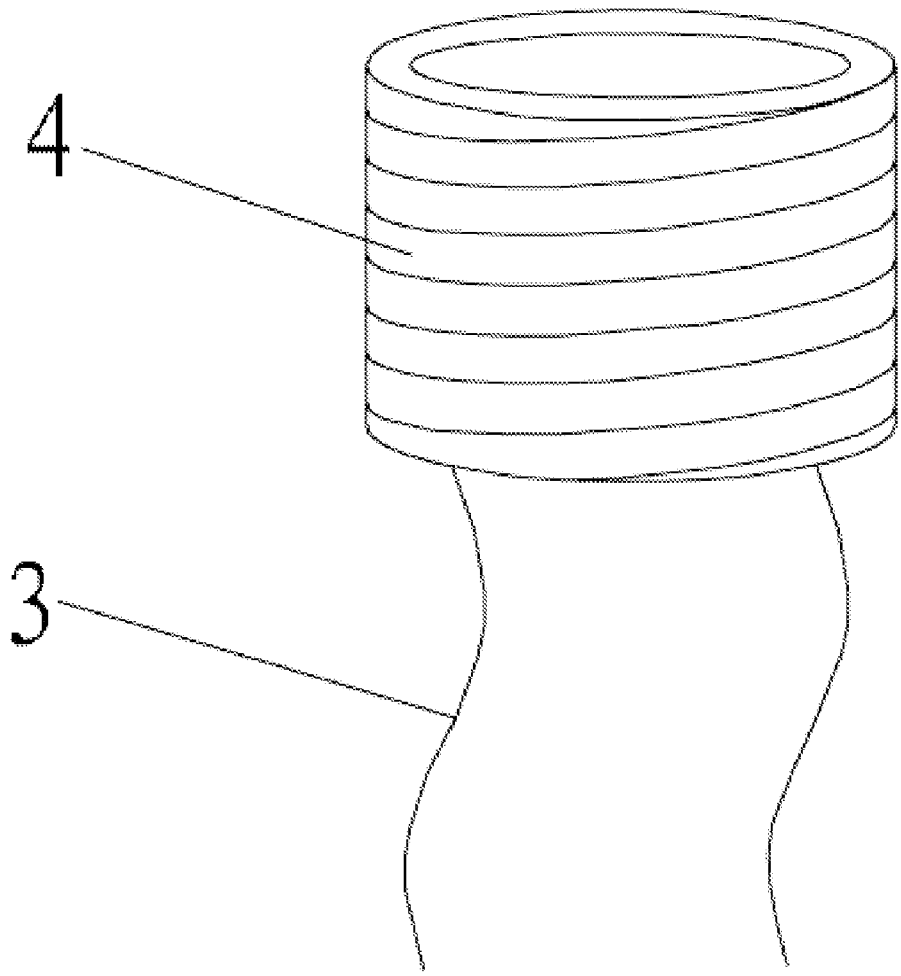
FIG. 3 depicts a schematic diagram of the overall structure of the second embodiment of the screw-shaped LED according to present invention.
Figure 4:
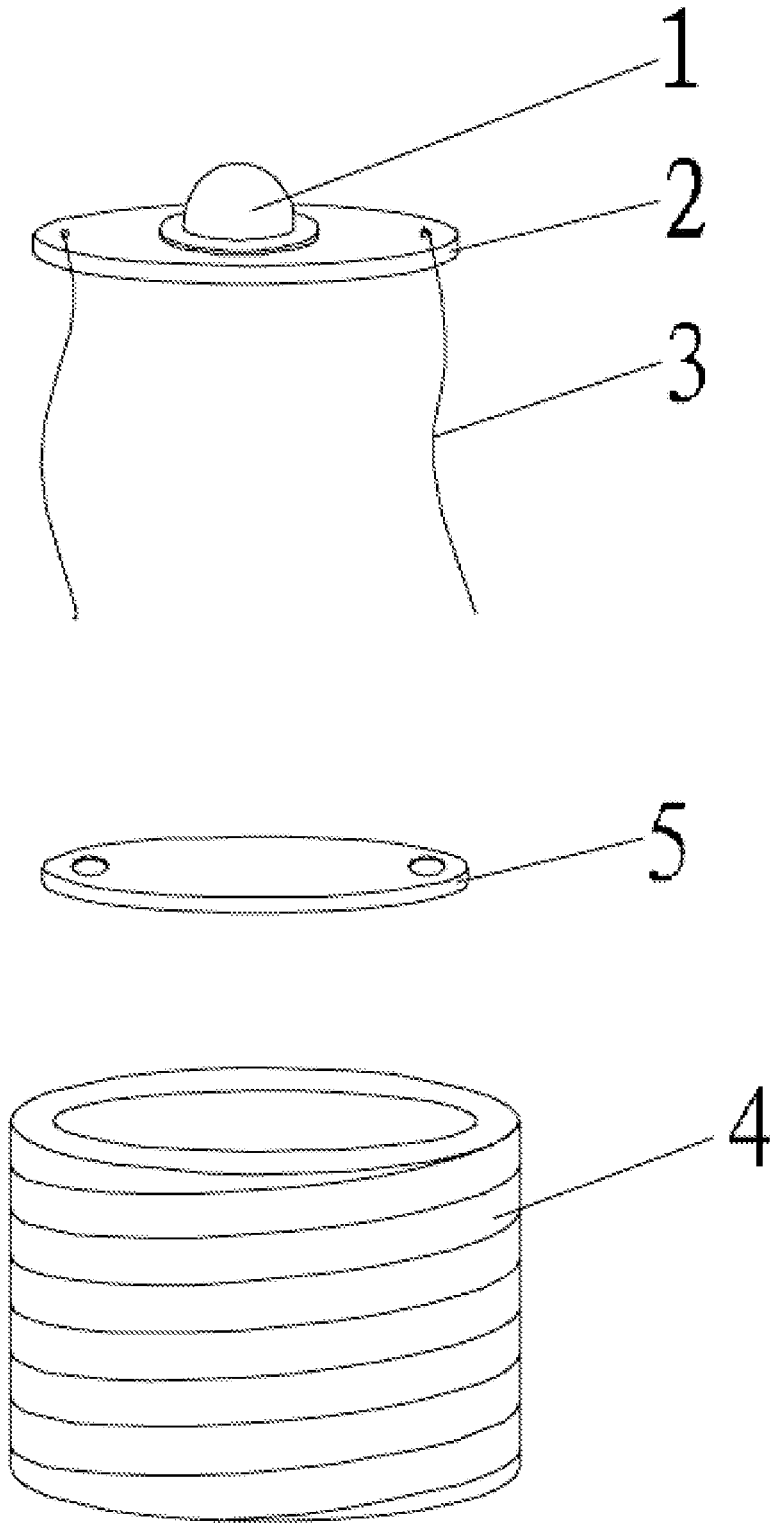
FIG. 4 depicts an exploded schematic diagram of the second embodiment of the screw-shaped LED according to present invention.

The second embodiment of the screw-shaped LED is shown in FIG. 3 and FIG. 4. One of the differences of the second embodiment from the first embodiment lies in that it further comprises a thermal conductor 5, which takes a form of a sheet shaped thermal conducting plate structure, and the thermal conductor 5 is disposed inside the screw-shaped housing 4 between the metal circuit board 2 and the bottom of the screw-shaped housing 4. It closely contacts with the metal circuit board 2 and with an inner wall of the screw-shaped housing 4, respectively.

The thermal conductor 5 is made of soft silica gel with good thermal conductivity. It may be also made of other thermal conducting materials. The heat generated during operation of the high power LED 1 is transferred rapidly through the thermal conductor 5 or other thermal conducting materials to the screw-shaped housing 4, dissipating easily therefrom.

The thermal conductor 5 in present embodiment may also adopt block shaped thermal conducting structure (e.g. by injection of soft silica gel), which surrounds the metal circuit board 2 and leaves a space corresponding to the high power LED 1.

Embodiment III

Figure 5:
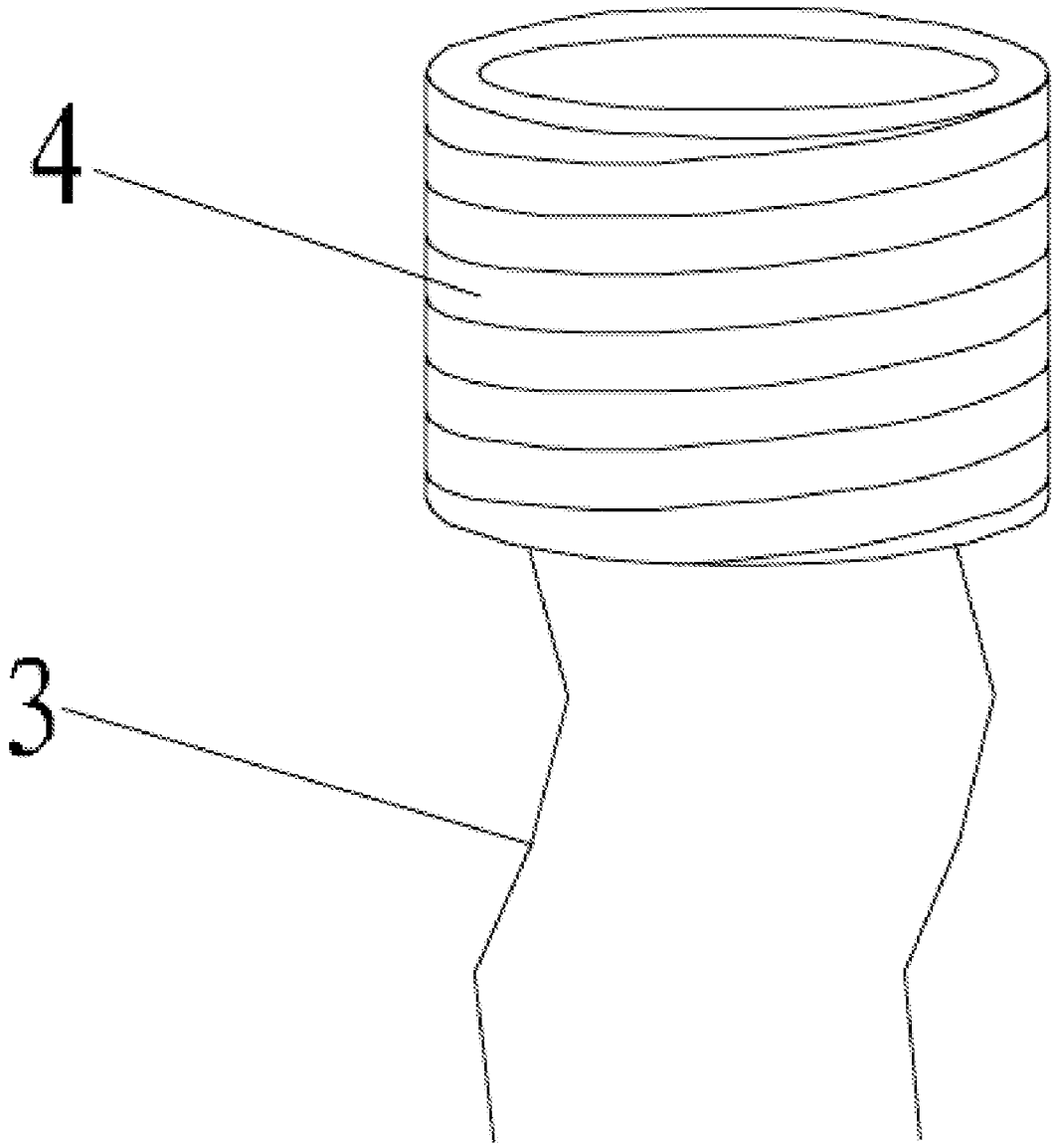
FIG. 5 depicts a schematic diagram of the overall structure of the third embodiment of the screw-shaped LED according to present invention.
Figure 6:
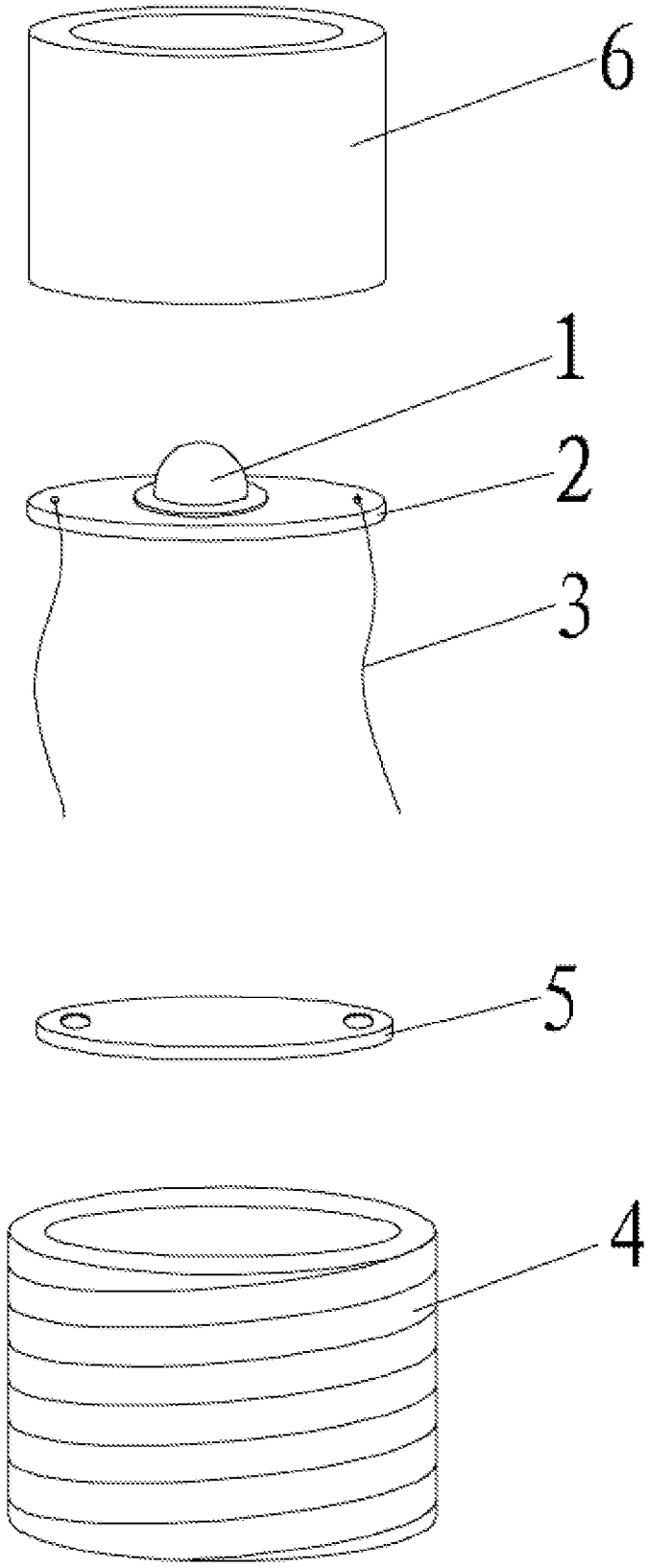
FIG. 6 depicts an exploded schematic diagram of the third embodiment of the screw-shaped LED according to present invention.

The third embodiment of the screw-shaped LED is shown in FIG. 5 and FIG. 6. One of the differences of the third embodiment from the second embodiment lies in that it further comprises a converging lens 6, which is disposed at the open end of the inner cavity of the screw-shaped housing 4. The converging lens 6 is positioned in a way according to the high power LED 1. It may be inserted into the screw-shaped housing 4. Alternatively, the converging lens 6 and the screw-shaped housing 4 may be threadly connected with each other. The converging lens 6 may focus the light emitted from the high power LED 1 in a way to meet the requirements of the users.

The assembly process of present embodiment is as follows: the high power LED 1 and the power cord 3 are soldered onto the metal circuit board 2, then the metal circuit board 2 is inserted into the screw-shaped housing 4, the power cord 3 is passed through the screw-shaped housing 4, the thermal conductor 5 or other thermal conducting materials is connected between the metal circuit board 2 and the screw-shaped housing 4, and the converging lens 6 is then mounted. Now, the screw-shaped LED as shown in FIG. 4 is assembled.

Figure 7:
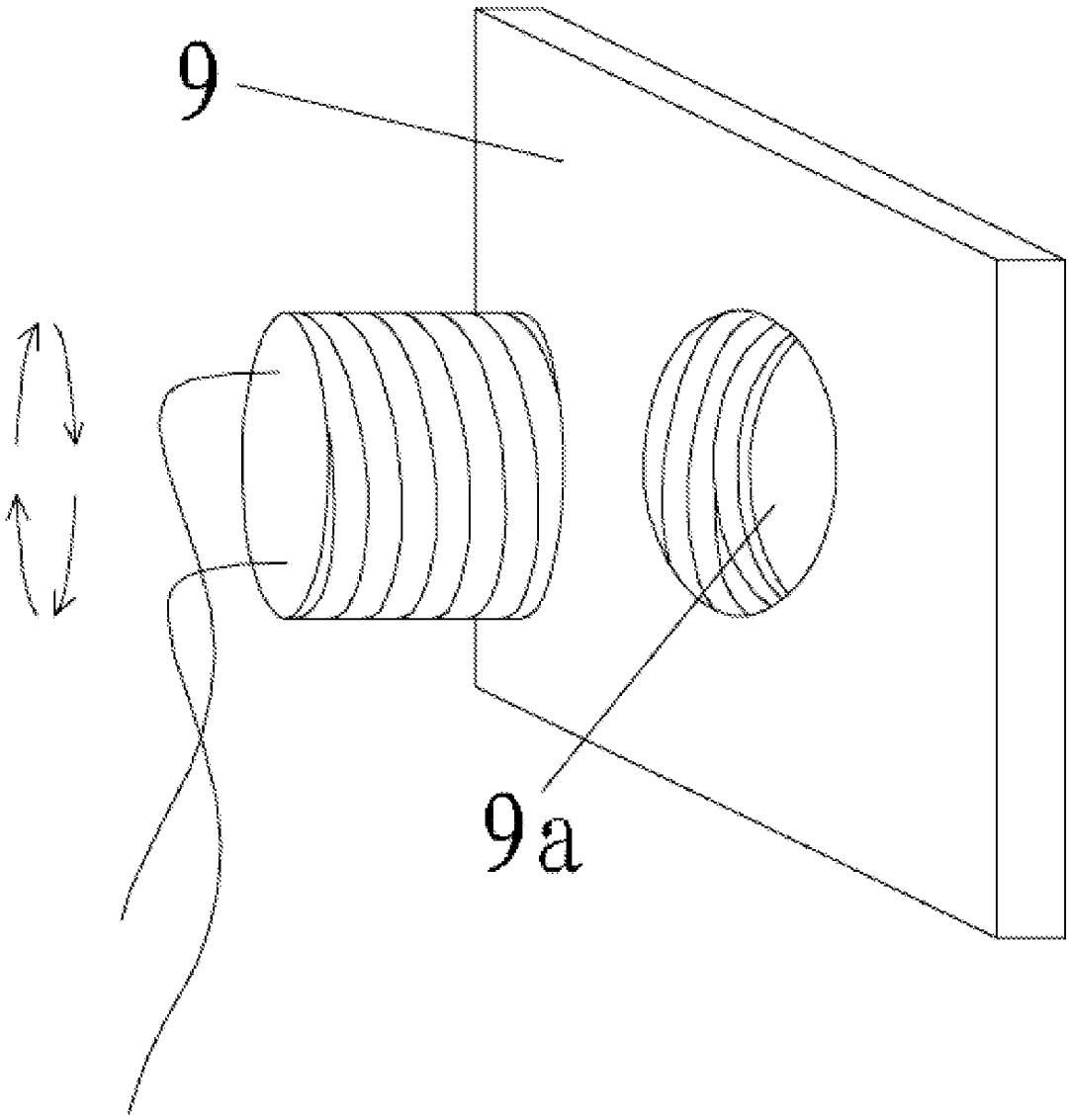
FIG. 7 depicts a schematic diagram for mounting of the third embodiment of the screw-shaped LED according to present invention.

As shown in FIG. 7, a mounting hole is drilled and threaded in accordance with the size and specification of the screw-shaped housing 4 at the position where a screw-shaped LED is to be mounted. The thread in the mounting hole 9*a*. in the mounting panel 9 matches with the outer thread on the screw-shaped housing 4. The screw-shaped LED is screwed directly into the mounting panel 9.

Figure 8:
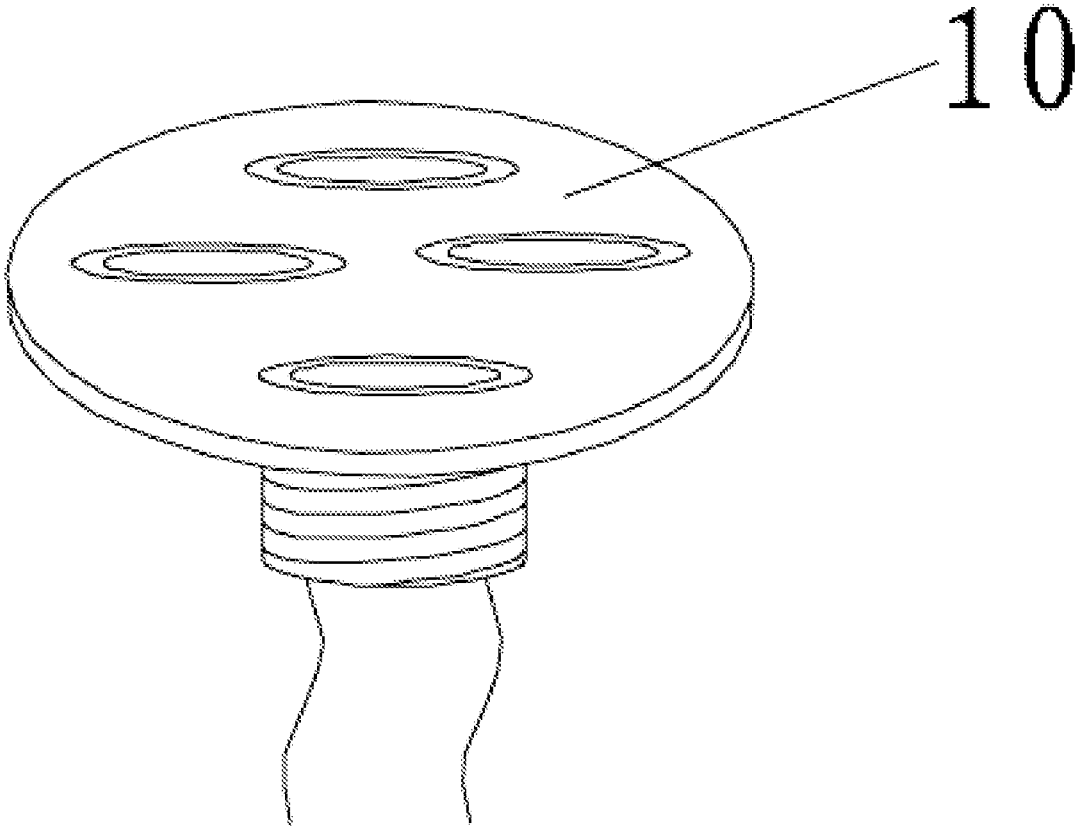
FIG. 8 depicts a schematic structure diagram of the cover lid for a lamp constituted with a plurality of the screw-shaped LED according to the third embodiment of present invention.

As shown in FIG. 8, a plurality of the screw-shaped LED according to present embodiment may be used together at the same time, wherein the plurality of the screw-shaped LED are mounted on the cover lid 10 of a lamp, resulting in a screw-shaped LED lamp. Due to the heat sinking difficulty being eliminated by the screw-shaped LED itself, it is possible to retrofit the lamps designed for current conventional light bulbs, such as street lamps, tunnel lamps, outer wall lamps, etc., which utilize conventional light bulbs of higher energy consumption. If the light bulbs and the lamps are replaced all together, it would waste a large amount of materials and also be unfriendly to the environment. With the screw-shaped LED according to present embodiment, it requires to remove only the cover lid, not the entire lamp, and replace it with a metal panel 10 according to the dimension of the original cover lid of the lamp. As every screw-shaped LED is a standardized element, including a standardized luminance, a cover lid for an LED lamp may be made by drilling and threading a mounting holes on the metal panel 10 according to the actual requirement of luminance. The mounting hole is sized in accordance with the specification of the screw-shaped housing 4 and are provided with a thread that matches with the outer thread on the screw-shaped housing 4. Then, the screw- shaped LED is screwed into the mounting hole. Thereafter, the screw-shaped LED is electrically connected, and the cover lid of the LED lamp is secured on the shell of the original lamp, resulting in an LED lamp. The heat generated by the screw-shaped LED may be further dissipated through the meal panel 10, which also enhances the durability and safety of the high power LED.

Embodiment IV

Figure 9:
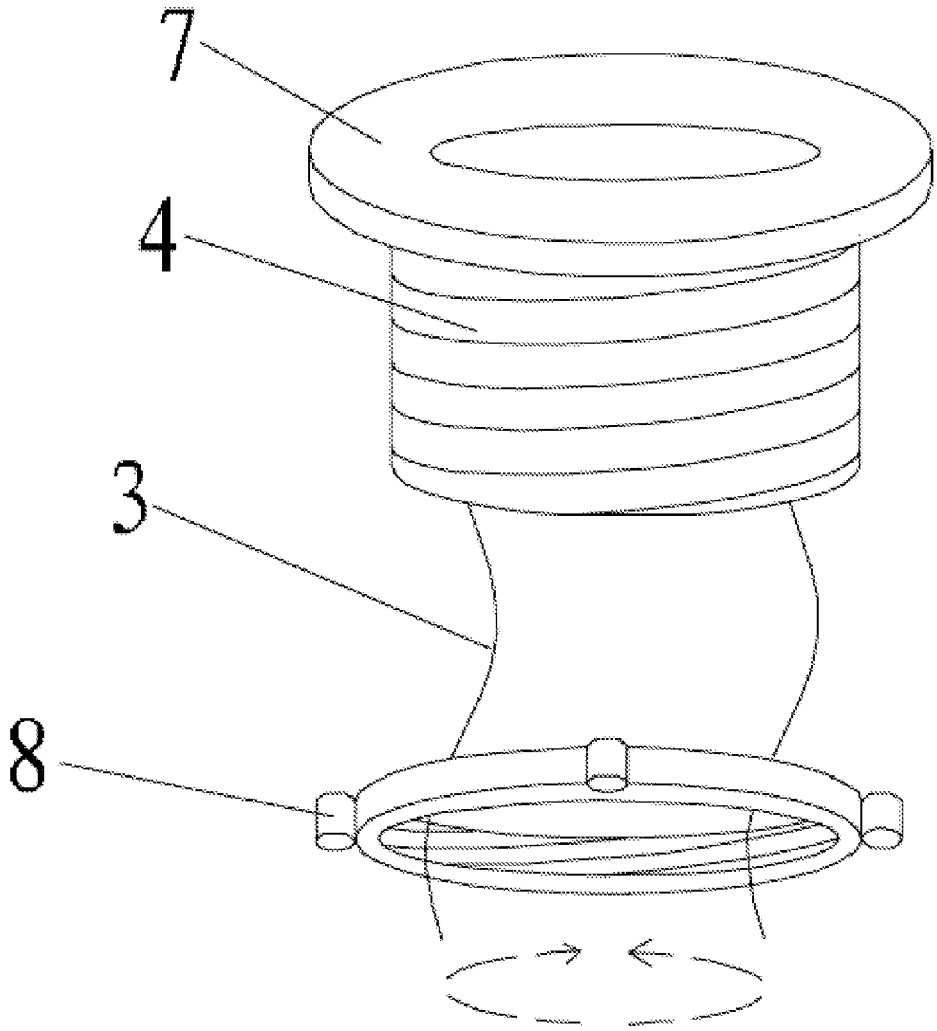
FIG. 9 depicts a schematic diagram of the overall structure of the fourth embodiment of the screw-shaped LED according to present invention.
Figure 10:
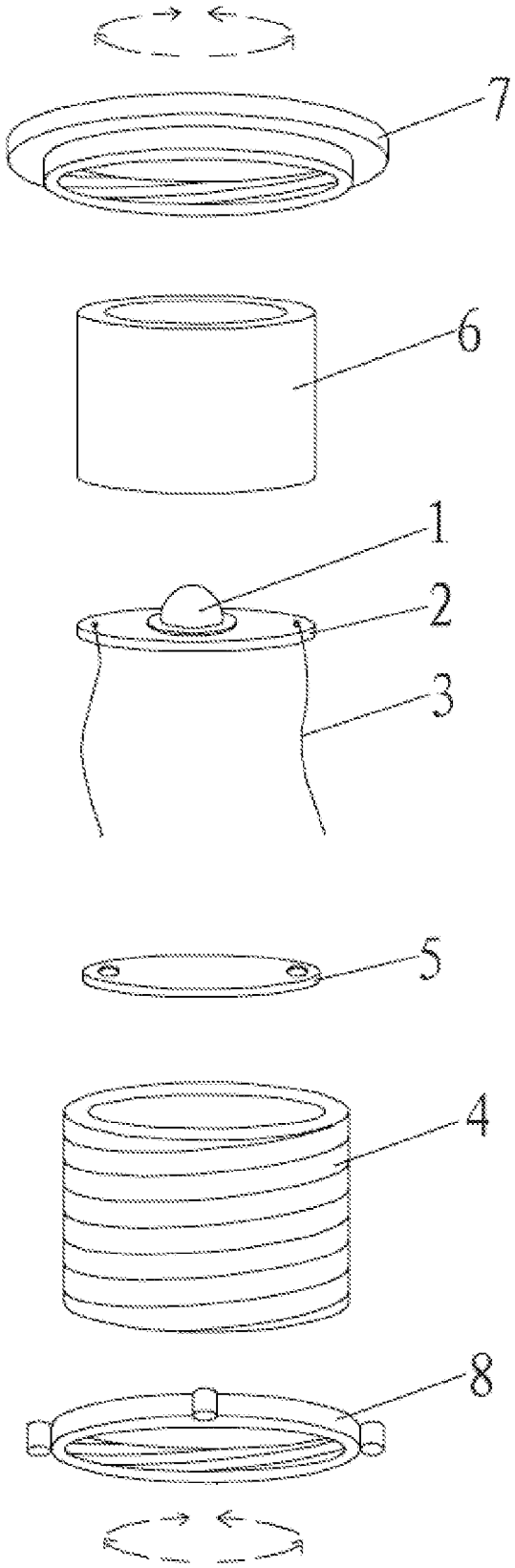
FIG. 10 depicts an exploded schematic diagram of the fourth embodiment of the screw-shaped LED according to present invention.

The fourth embodiment of the screw-shaped LED is shown in FIG. 9 and FIG. 10. One of the differences of the fourth embodiment from the third embodiment lies in that it further comprises a positioning mechanism for mounting, which is threadly connected with the screw-shaped housing 4 and includes a cover lid 7 and a fixing ring 8, where the inner wall of the cover lid 7 and the inner wall of the fixing ring 8 both have a thread that matches the outer thread of the screw-shaped housing 4, respectively.

The assembly process for this embodiment is as follows: the high power LED 1 and the power cord 3 are soldered on the metal circuit board 2, then the metal circuit board 2 is inserted into the screw-shaped housing 4, the power cord 3 extends though the screw-shaped housing 4, an insulated thermal conductor 5 or other thermal conducting materials is disposed between the metal circuit board 2 and the screw-shaped housing 4, the converging lens 6 is mounted, and then the cover lid 7 and the fixing ring 8 are screwed into the screw-shaped housing 4. Now, a screw-shaped LED of high power as shown in FIG. 8 is assembled.

Figure 11:
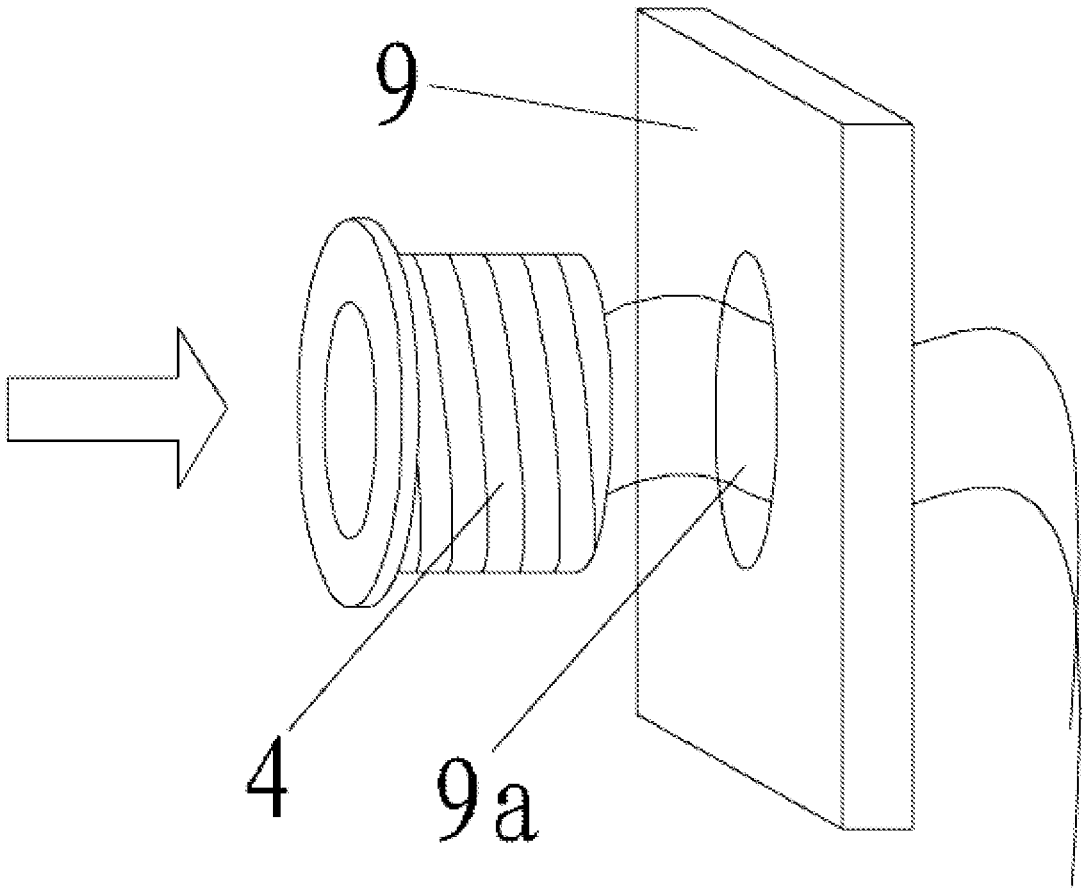
FIG. 11 depicts a schematic diagram for mounting of the fourth embodiment of the screw-shaped LED according to present invention.
Figure 12:
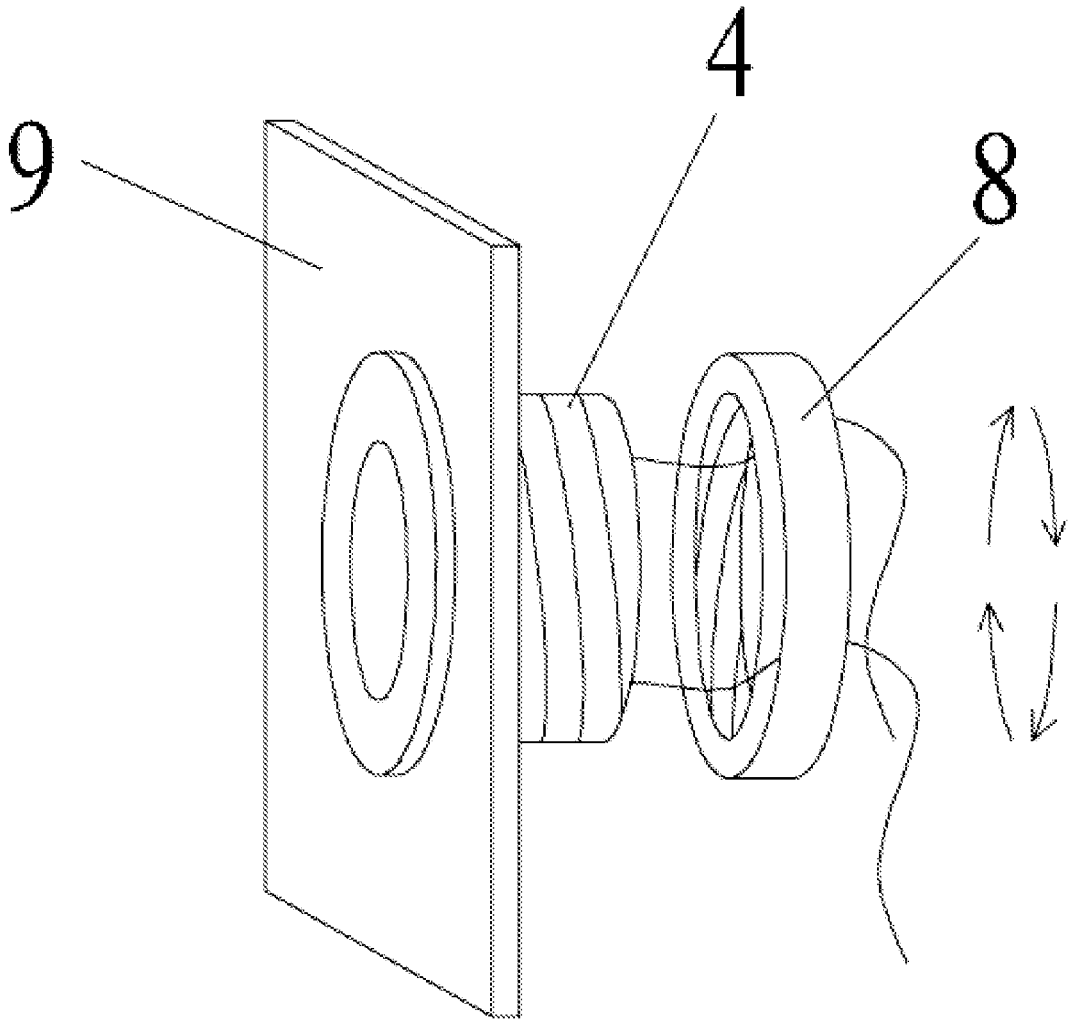
FIG. 12 depicts another schematic diagram for mounting of the fourth embodiment of the screw-shaped LED according to present invention.

Similarly, this embodiment requires only replacement of the cover lid for the conventional lamps. A cover lid for an LED lamp is made by making a metal panel in accordance with the size of the cover lid for the original lamp. On the metal panel, a number of holes (the number of the holes corresponds to the number of the screw-shaped LEDs that are to be mounted) in accordance with the specification of the screw-shaped housing and the actual luminance requirement. As shown in FIG. 11, a mounting hole 9*a*. is drilled in the mounting panel 9 at the position where the screw-shaped LED is to be mounted. The screw-shaped LED is then screwed into the mounting hole 9*a*, as shown in FIG. 12. Next, the fixing ring 8 is screwed onto the screw-shaped housing 4 until the screw-shaped LED with the cover lid 7 is compressed against the mounting panel 9. Thereafter, the screw-shaped LED is electrically connected, and the cover lid of the LED lamp is secured on the shell of the original lamp, thereby finishing the installation of the LED lamp. The heat generated by the screw-shaped LED may be further dissipated through the meal panel 9, which further increases the durability and safety of the high power LED.

In summary, with the above preferred embodiments of the present invention being described, it would be apparent to those skilled in the art that those embodiments may be subject to many changes and modifications without departing the spirits of the invention. Thus, all such changes and modifications shall fall into the scope of present invention unless such changes and modifications depart from the spirit of present invention.

What is claimed is:

1. A screw-like LED device, comprising a high power LED, a circuit board, a power supply cord, and a housing which is of a substantially cylinder shape covered with an outer thread, wherein said LED is secured on and electrically connected to said circuit board disposed inside said housing.

2. The screw-like LED device of claim 1, wherein said housing is a sleeve structure and has an inner cavity with an open end and a closed end, into which said LED and said board are disposed.

3. The screw-like LED device of claim 2, further comprising a thermal conductor disposed inside said housing and in contacting with said housing and said circuit board, respectfully.

4. The screw-like LED device of claim 3, wherein said thermal conductor is in a form of a sheet structure positioned between said circuit board and a bottom surface of said housing and in close contact with both said circuit board and said bottom surface.

5. The screw-like LED device of claim 3, wherein said thermal conductor is in a form of a block structure surrounding said circuit board but leave a space to accommodate said LED.

6. The screw-like LED device of claim 3, wherein said thermal conductor is made of soft silica gel.

7. The screw-like LED device of claim 1, further comprising a converging lens.

8. The screw-like LED device of claim 7, further comprising a positioning mechanism for mounting on a panel which is too thin to mount directly.

9. The screw-like LED device of claim 7, wherein said positioning mechanism comprises a cover lid and a fixing ring and said cover lid and fixing ring each have an inner thread matching with said outer thread of said housing.

10. The screw-like LED device of claim 1, wherein said high power LED has a power rating greater than 1W.

11. The screw-like LED device of claim 1, wherein said high power LED has a power rating is selected from the ground consisting 1W, 3W and 5W.

* * * * *